US008905339B2

(12) United States Patent
Tabata et al.

(10) Patent No.: US 8,905,339 B2
(45) Date of Patent: Dec. 9, 2014

(54) LIQUID DEVELOPER-PREPARING APPARATUS

(75) Inventors: Kazuaki Tabata, Kanagawa (JP); Hiroyuki Moriya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 361 days.

(21) Appl. No.: 13/544,457

(22) Filed: Jul. 9, 2012

(65) Prior Publication Data

US 2013/0186991 A1 Jul. 25, 2013

(30) Foreign Application Priority Data

Jan. 23, 2012 (JP) ..... 2012-011106

(51) Int. Cl.
*B02C 4/32* (2006.01)

(52) U.S. Cl.
USPC ..... 241/36; 241/101.8; 241/182

(58) Field of Classification Search
USPC ..... 241/21, 33, 36, 101.8, 172, 182
See application file for complete search history.

(56) References Cited

U.S. PATENT DOCUMENTS

| | | | | |
|---|---|---|---|---|
| 5,624,079 | A * | 4/1997 | Higuchi et al. | 241/39 |
| 5,695,132 | A * | 12/1997 | Gorzka et al. | 241/39 |
| 6,634,576 | B2 * | 10/2003 | Verhoff et al. | 241/21 |
| 7,441,717 | B1 * | 10/2008 | Majka et al. | 241/21 |
| 7,770,828 | B2 * | 8/2010 | Matsumoto et al. | 241/16 |
| 2009/0258310 | A1 | 10/2009 | Matsumoto et al. | |

FOREIGN PATENT DOCUMENTS

| | | |
|---|---|---|
| JP | A-2007-041027 | 2/2007 |
| JP | A-2009-249579 | 10/2009 |

* cited by examiner

*Primary Examiner* — Faye Francis
*Assistant Examiner* — Onekki Jolly
(74) *Attorney, Agent, or Firm* — Oliff PLC

(57) ABSTRACT

Provided is a liquid developer-preparing apparatus preparing a liquid developer obtained by dispersing toner particles in a liquid, the apparatus including, a tank that stores a dispersion including a liquid and toner particles, a pulverizing device that pulverizes the toner particles in the dispersion sent from the tank; a liquid-sending route in which the dispersion circulates between the tank and the pulverizing device, a liquid-sending device that is provided to the liquid-sending route and sends the dispersion, a pressure gauge that is provided to the liquid-sending route and measures a liquid-sending pressure of the dispersion, and a determination device that determines whether or not the toner particles in the dispersion have been pulverized to a target volume average particle size.

6 Claims, 7 Drawing Sheets

LIQUID DEVELOPER-PREPARING APPARATUS

CROSS-REFERENCE TO RELATED APPLICATIONS

This application is based on and claims priority under 35 USC 119 from Japanese Patent Application No. 2012-011106 filed Jan. 23, 2012.

BACKGROUND

1. Technical Field

The present invention relates to a liquid developer-preparing apparatus.

2. Related Art

As developers used for developing an electrostatic latent image formed on a latent image carrier, there are a dry toner which refers to a toner used in a dry state and constituted with materials including a colorant such as a pigment and a binder resin, and a liquid developer which is obtained by dispersing a toner in a carrier liquid having electrical insulation properties.

The dry toner is prepared by a dry pulverizing method that pulverizes materials including a colorant and a binder resin in a dry state. On the other hand, for the liquid developer, an insulating liquid is used as a medium, and toner particles in the liquid developer are pulverized in a wet state. Accordingly, a developer containing toner particles having a volume average particle size smaller than that of the above dry toner is obtained. Compared to the dry toner, the liquid developer obtained by the wet pulverizing method described above shows superior reproducibility of fine line images, gradation reproducibility, and color reproducibility and is more optimal for a high-speed image forming method.

In recent years, as resolution has been increased in forming images, yet smaller toner particles compared to the volume average particle size of toner particles in the related art have been required. However, in a method of preparing a liquid developer used in the related art, it takes a long time for pulverizing toner particles to obtain a volume average particle size required for high resolution, and large pulverizing energy is required. In addition, in the wet pulverizing method used in the related art, when the dispersibility of toner particles in a liquid developer is insufficient, sedimentation of the toner particles is caused when the developer is left as is for a long time, and the toner particles in the liquid developer aggregate in some cases.

In order to obtain a liquid developer in which small-sized toner particles suitable for high resolution are stably dispersed, several methods have been proposed.

SUMMARY

According to an aspect of the invention, there is provided a liquid developer-preparing apparatus preparing a liquid developer obtained by dispersing toner particles in a liquid, the apparatus including a tank that stores a first dispersion including a liquid and toner particles; a pulverizing device that pulverizes the toner particles in the first dispersion sent from the tank; a liquid-sending route in which the first dispersion circulates between the tank and the pulverizing device; a liquid-sending device that is provided to the liquid-sending route and sends the first dispersion; a pressure gauge that is provided to the liquid-sending route and measures a liquid-sending pressure of the first dispersion; and a determination device that determines whether or not the toner particles in the first dispersion have been pulverized to a target volume average particle size, by comparing the liquid-sending pressure measured by the pressure gauge with a liquid-sending pressure obtained when the toner particles have the target volume average particle size, which is a pressure measured in advance using a second dispersion having the same composition as that of the first dispersion.

BRIEF DESCRIPTION OF THE DRAWINGS

Exemplary embodiments of the present invention will be described in detail based on the following figures, wherein.

DETAILED DESCRIPTION

Figure 1:
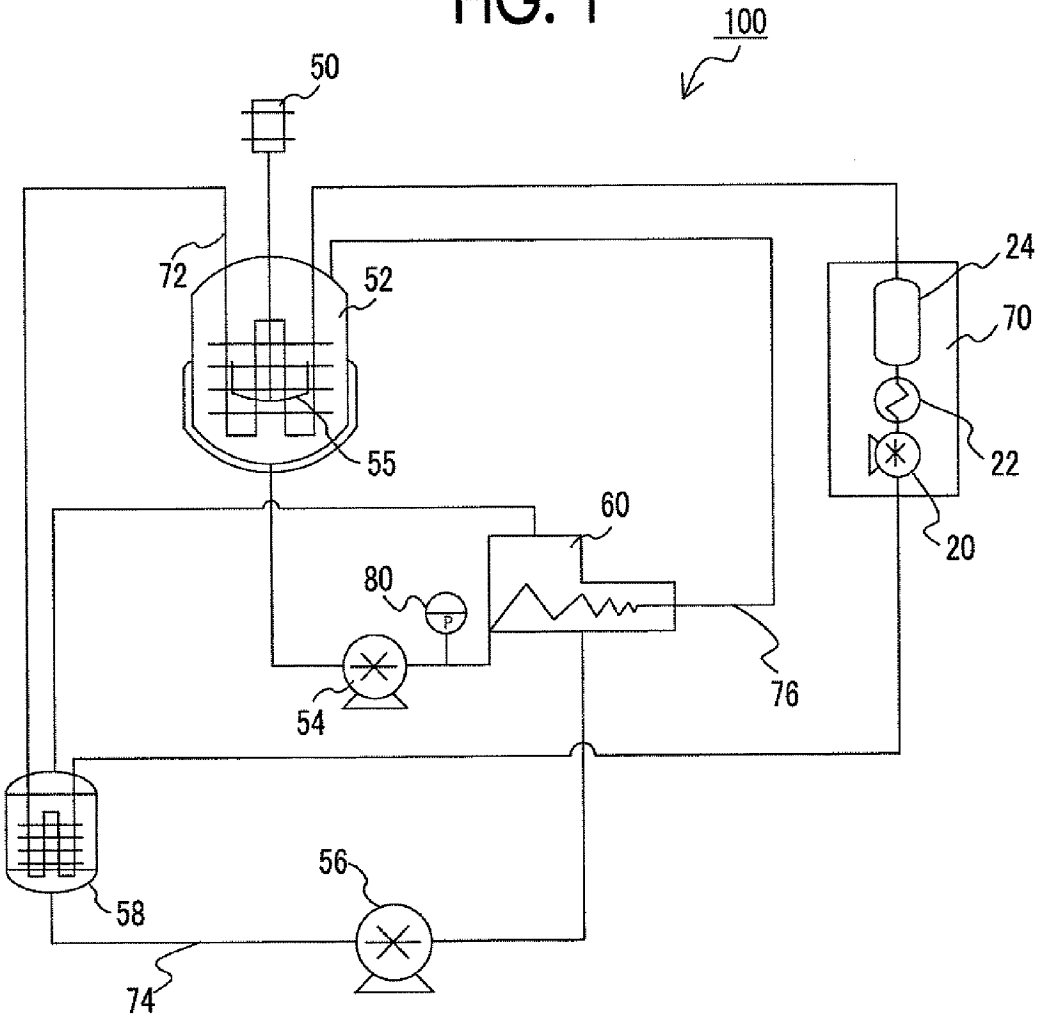
FIG. 1 is a schematic view showing an example of the constitution of a liquid developer-preparing apparatus of the present exemplary embodiment.

An example of the constitution of the liquid developer-preparing apparatus of the present exemplary embodiment will be described below using FIG. 1.

A liquid developer-preparing apparatus 100 (hereinbelow, abbreviated to a "preparation apparatus 100") of the present exemplary embodiment includes a tank 52 that stores a first dispersion including a liquid and toner particles; a pulverizing device 60 that pulverizes the toner particles in the first dispersion sent from the tank 52; a liquid-sending route 76 in which the first dispersion circulates between the tank 52 and the pulverizing device 60; a liquid-sending device 54 that is provided to the liquid-sending route 76 and sends the first dispersion; a pressure gauge 80 that is provided to the liquid-sending route 76 and measures a liquid-sending pressure of the first dispersion; and a determination device (not shown in the drawing) that determines whether or not the toner particles in the first dispersion have been pulverized to a target volume average particle size, by comparing the liquid-sending pressure measured by the pressure gauge 80 with a liquid-sending pressure obtained when the toner particles have the target volume average particle size, which is a pressure measured in advance using a second dispersion having the same composition as that of the first dispersion.

The determination device may be provided to the inside of a control device (not shown in the drawing) that controls the pulverizing device 60, the liquid-sending device 54, and the pressure gauge 80, or may be provided separately from the control device. In addition, the determination device stores the following relational expression between a liquid-sending pressure that is obtained by being measured in advance using a dispersion having the same composition as that of the above dispersion and a volume average particle size of the toner particles in the dispersion:

$$P=AD_0-BD$$

(in the expression, A and B represent constants that are determined by being measured in advance using a dispersion having the same composition as that of the above dispersion, $D_0$ represents an initial volume average particle size of the toner particles, D represents a target volume average particle size of the toner particles, and P represents a liquid-sending pressure at the time of the target volume average particle size).

When the liquid-sending pressure measured by the pressure gauge 80 becomes a liquid-sending pressure P at the time of the stored target volume average particle size, the determination device determines that pulverizing of the toner particles has been completed. In response to the determination results from the determination device, the control device stops driving of the pulverizing device 60 and the liquid-sending device 54. The determination device will be described later.

In the preparation apparatus 100 of the present exemplary embodiment, a stirring device 50 that stirs the dispersion is provided to the tank 52, and the stirring device 50 includes, for example, a stirring rod having a stirring blade and a driving device rotating the stirring rod, as shown in FIG. 1. By providing a stirring tank 50 to the tank 52, sedimentation of the toner particles caused in the dispersion in the tank 52 is inhibited. Consequently, presumably, since the amount of toner particles in the dispersion sent to the pulverizing device 60 from the tank 52 is within a predetermined range, the efficiency of pulverizing toner particles in the pulverizing device 60 is improved, and variation in the volume average particle size of the toner particles in the obtained liquid developer becomes smaller compared to a case where stirring is not performed.

A temperature adjustor 70 that adjusts the temperature of the dispersion is provided to the preparation apparatus 100 of the present exemplary embodiment, and the temperature adjustor 70 is provided with a pump 20, a heat exchanger 22, and a cooling water tank 24. As the temperature adjustor 70, for example, a water cooled chiller is used. The cooling water sent from the temperature adjustor 70 by using the pump 20 passes the tank 52 and a seal water-storing tank 58 and returns to the temperature adjustor 70, via a route 72 of cooling water circulating through the temperature adjustor 70, the tank 52, and the seal water-storing tank 58.

As the pulverizing device 60 in the present exemplary embodiment, for example, a known pulverizing device such as a ball mill, a beads mill, or a high-pressure wet type fine particle-preparing device is used. In the preparation apparatus 100 shown in FIG. 1, a wet type medium stirring mill using beads is used as the pulverizing device 60, seal water for sealing the wet type medium stirring mill is stored in the seal water-storing tank 58, and the seal water-storing tank 58 is cooled at a predetermined temperature by cooling water from the temperature adjustor 70. Therefore, the seal water adjusted to a predetermined temperature circulates between the wet type medium-stirring mill as the pulverizing device 60 and the seal water-storing tank 58, via a pump 56 provided to a seal water circulation route 74.

The viscosity of the dispersion tends to increase as the toner particles are pulverized further. Moreover, the viscosity of the dispersion tends to decrease as a liquid-sending temperature increases, and on the other hand, the viscosity of the dispersion tends to increase as a liquid-sending temperature decreases. Accordingly, it is considered that if the temperature of the dispersion in the tank 52 and the temperature of the dispersion in the pulverizing device 60 are adjusted to be the same in the liquid developer-preparing apparatus 100 of the present exemplary embodiment as described above, the "fluctuation of the liquid-sending pressure of the dispersion" caused by temperature change is excluded, and the accuracy of determining the completion of pulverizing of the toner particles by using the above relational expression relating to a target volume average particle size is improved.

The wet type medium stirring mill using beads, which is used as the pulverizing device 60 in the present exemplary embodiment, will be described. The beads are at least one kind of beads selected from a group consisting of zirconia, alumina, and glass. The diameter of the beads is from 0.2 mm to 3 mm (or from about 0.2 mm to about 3 mm), a beads filling rate in a cylinder of the wet type medium stirring mill is 75% or higher (or about 75% or higher), and a circumferential speed of an agitator disc of the wet type medium stirring mill is from 5 m/s to 20 m/s (or from about 5 m/s to about 20 m/s). If the toner particles are pulverized by the wet type medium stirring mill operated in the range of the above condition, a liquid developer including toner particles having a particle size equivalent or closer to the target volume average particle size is prepared.

Next, the operation of the determination device of the present exemplary embodiment will be described. The above relational expression stored in the determination device is obtained by carrying out a preliminary experiment by using a dispersion having the same composition as that of the above dispersion used in preparing the liquid developer. In addition, it is considered that by setting the pipe diameter of the liquid-sending route 76, the temperature of the dispersion sent inside the liquid-sending route 76, the pump pressure of the liquid-sending device 54 provided to the liquid-sending route 76, pulverizing conditions of the pulverizing device 60, and the like to be the same as the conditions at the time of preparing the liquid developer, a relational expression having higher correlation with the dispersion used in actually preparing the liquid developer is obtained.

Figure 2:
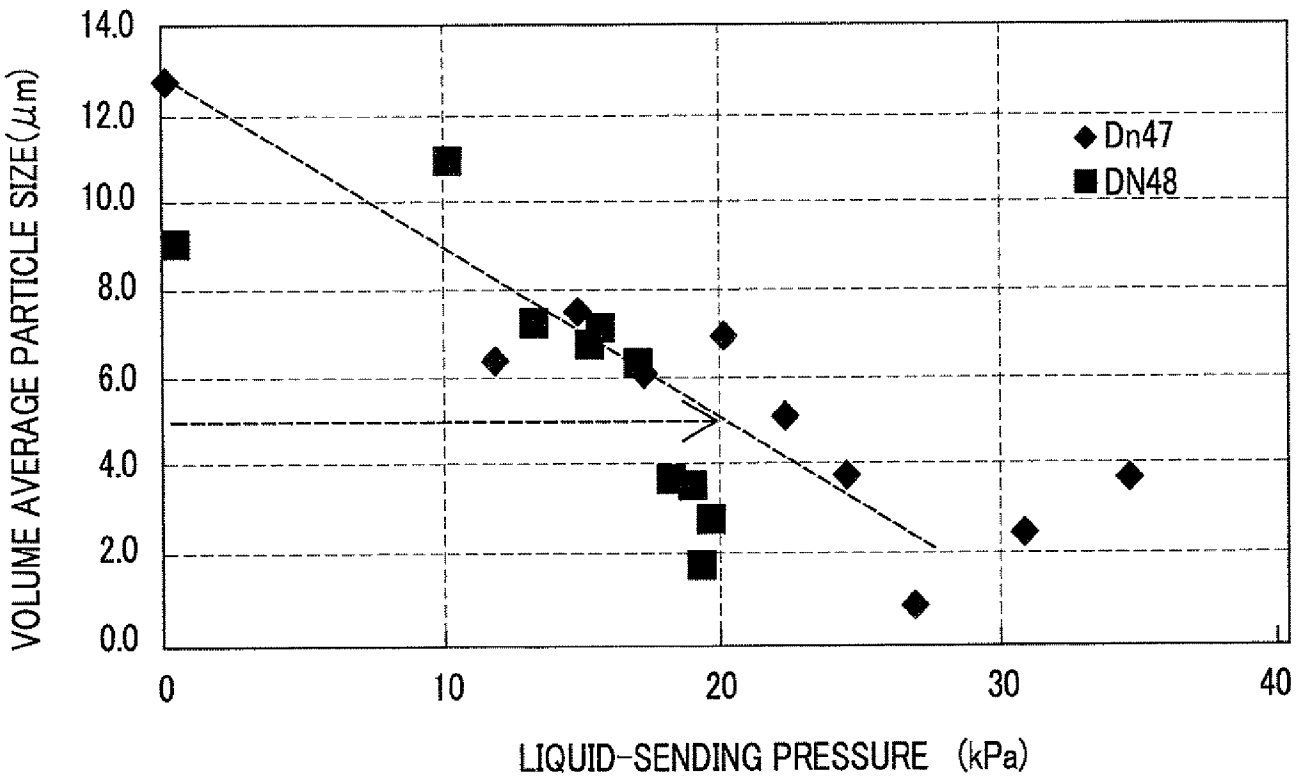
FIG. 2 is a graph showing an example of the relationship between an actually measured volume average particle size of toner particles in a dispersion having a specific composition and a liquid-sending pressure of the dispersion in a step of pulverizing of the present exemplary embodiment.

The graph shown in FIG. 2 shows results of an example of the relationship between an actually measured volume average particle size of toner particles in a dispersion having a specific composition and a liquid-sending pressure of the dispersion, which are results obtained in a preliminary experiment through a step of pulverizing of the present exemplary embodiment by using the preparation apparatus 100 shown in FIG. 1. In FIG. 2, coarse particles of the toner having the same composition are used to measure twice the liquid-sending pressure over time in the step of pulverizing, and at this time, the dispersion is collected to measure the volume average particle size of the pulverized toner particles by using a laser diffraction/scattering type particle size distribution analyzer "LA-920" (manufactured by HORIBA, Ltd.), whereby the relationship between the volume average particle size of the pulverized toner particles and the liquid-sending pressure is indicated as a graph ("◆: Dn47" and "■: DN48" in FIG. 2). The straight line indicated as a dotted line is obtained by a least-squares method by plotting the volume average particle size actually measured by the above method and the liquid-sending pressure. This line corresponds to the relational expression: $P=AD_0-BD$ (in the expression, A and B represent constants that are determined by being measured in advance using a dispersion having the same composition as that of the above dispersion, $D_0$ represents an initial volume average particle size of the toner particles, D represents a target volume average particle size of the toner particles, and P represents a liquid-sending pressure at the time of the target volume average particle size). As shown in FIG. 2, as the pulverizing of the toner of coarse particles proceeds, the specific surface area of the toner particles in the toner particle dispersion increases. From this result, it is understood that the increase in the viscosity of the dispersion increases the liquid-sending pressure of the dispersion, and that the volume average particle size of the toner particles decreases in correlation with the increase in pressure.

Figure 3:
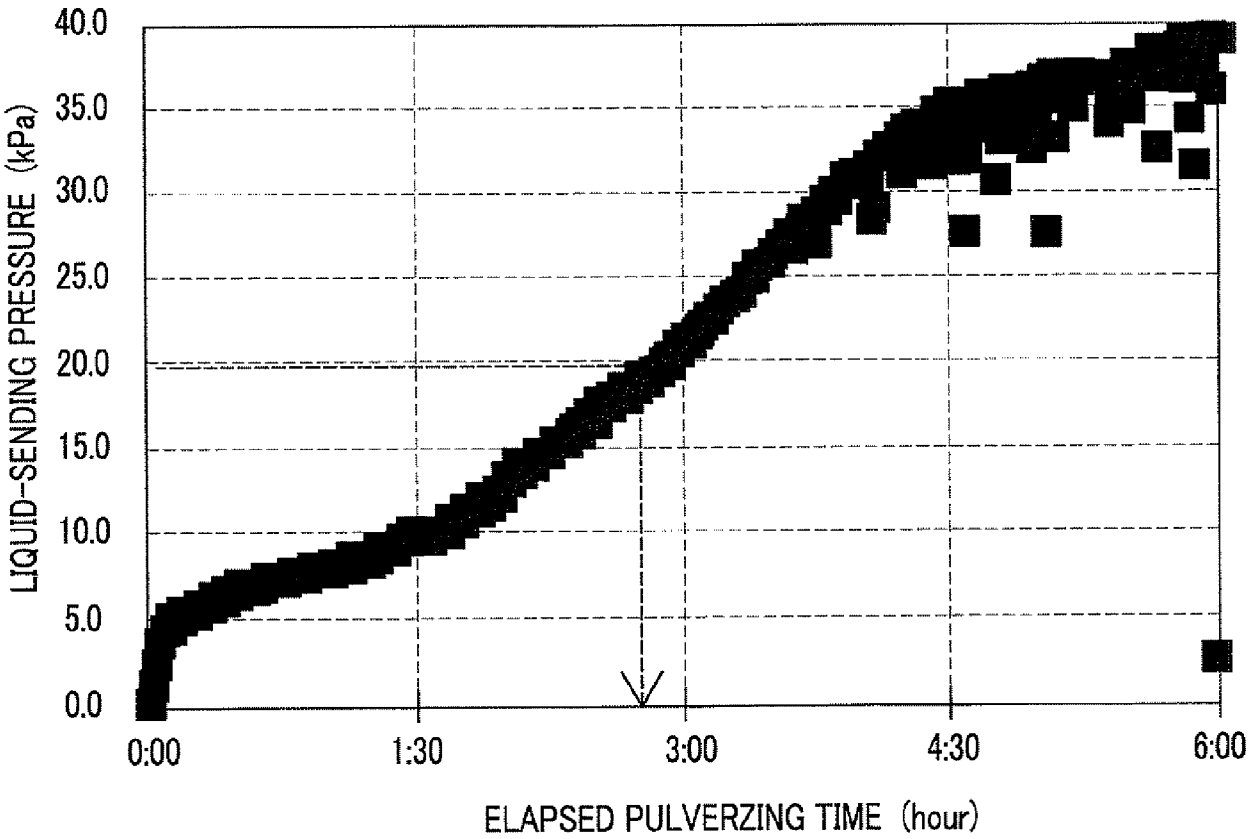
FIG. 3 is a graph showing an example of the relationship between an actually measured liquid-sending pressure of a dispersion having the same composition as in the case of FIG. 2 and elapsed pulverizing time in the step of pulverizing of the present exemplary embodiment.

The graph shown in FIG. 3 is created by carrying out a preliminary experiment by using a dispersion having the same composition as that of the above dispersion used for creating the graph of FIG. 2 and by plotting the relationship between the liquid-sending pressure and the elapsed pulverizing time by using the preparation apparatus 100 shown in FIG. 1.

In the determination device of the preparation apparatus 100 in the present exemplary embodiment, the relational expression is stored in a plural number for each of the dispersions having plural compositions obtained by the preliminary experiment data shown in FIG. 2. Accordingly, the determination device appropriately selects a relational expression according to the composition of the dispersion used at the time of actually preparing a liquid developer and monitors the liquid-sending pressure of the dispersion, whereby a dispersion is obtained which includes toner particles having a volume average particle size desired to be obtained at the time of preparing a liquid developer. Moreover, since the determination device also stores the relationship between the liquid-sending pressure in the composition of each dispersion shown in FIG. 3 and the elapsed pulverizing time, the pulverizing time of the dispersion including the toner particles having a volume average particle size desired to be obtained at the time of preparing a liquid developer is predicted.

Generally, it is difficult to measure a volume average particle size of a toner in a dispersion in-situ. However, in the preparation apparatus 100 of the present exemplary embodiment, when toner particles in a dispersion are pulverized, the actually measured liquid-sending pressure of the dispersion is compared with a liquid-sending pressure at the time of a target volume average particle size measured in advance using a dispersion having the same composition. Therefore, a step of pulverizing toner particles is managed to such a degree which is almost equivalent to a case of measuring the volume average particle size in-situ.

For example, if pulverizing is ended at a point in time (the arrow of dotted line in FIG. 2) when the volume average particle size of the toner particles becomes 4 μm based on the relational expression shown in FIG. 2, the pulverizing device 60 of the liquid developer-preparing apparatus 100 may be stopped when the liquid-sending pressure becomes 20 kPa. It is understood that the elapsed pulverizing time at this time is 2 hours and 50 minutes as shown in FIG. 3.

Next, the liquid developer prepared in the present exemplary embodiment will be described. The liquid developer of the present exemplary embodiment is obtained by dispersing toner particles in an insulating liquid.

Hereinbelow, components constituting the liquid developer will be described in more detail.

Toner Particles

Toner particles include at least a binder resin, and optionally may include other components such as a colorant, a release agent, and a polymerization initiator.

Binder Resin

The binder resin is not particularly limited, and examples thereof include polyester, polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene, and the like. Moreover, polyurethane, an epoxy resin, a silicone resin, polyamide, modified rosin, and paraffin wax may be used. As the binder resin, the above binder resins may be used alone, or two or more kinds of the resins may be used as a mixture.

As a constitution using two or more kinds of the resins as a mixture, for example, a mixture of a thermoplastic resin and a thermoplastic elastomer is exemplified. More specific examples thereof include a mixture of a styrene-based thermoplastic resin and a styrene-based thermoplastic elastomer resin.

The styrene-based thermoplastic resin refers to a thermoplastic resin having a repeating unit derived from a monomer having a styrene structure (hereinbelow, referred to as a "styrene-based monomer" in some cases). The "repeating unit derived from a styrene-based monomer" refers to a repeating unit generated as a result of the reaction of a styrene-based monomer, among repeating units constituting a polymer. The same definition is applied to repeating units derived from another monomer.

Examples of the styrene-based monomer include styrene, p-ethylstyrene, 2,4-dimethylstyrene, p-n-butylstyrene, p-ter-butylstyrene, p-n-hexylstyrene, p-n-octylstyrene, p-n-dodecylstyrene, p-methoxystyrene, p-phenylstyrene, p-chlorostyrene, 3,4-dichlorostyrene, and the like.

The styrene-based thermoplastic resin may be a copolymer of a styrene monomer with another monomer. Examples of another monomer include a monomer having an acrylic acid ester structure (hereinbelow, referred to as an "acrylic acid ester-based monomer" in some cases), another monomer having a vinyl group (hereinbelow, referred to as a "vinyl-based monomer" in some cases), and the like.

Specific examples of the acrylic acid ester-based monomer include alkyl esters of (meth)acrylic acid such as methyl (meth)acrylate, ethyl (meth)acrylate, propyl (meth)acrylate, n-butyl (meth)acrylate, isobutyl (meth)acrylate, n-octyl (meth)acrylate, dodecyl (meth)acrylate, 2-ethylhexyl acrylate, and stearyl (meth)acrylate, 2-chloroethyl acrylate, phenyl (meth)acrylate, α-chloromethyl acrylate, 2-hydroxyethyl (meth)acrylate, 2-hydroxypropyl (meth)acrylate, 2-hydroxybutyl (meth)acrylate, glycidyl (meth)acrylate, dimethylaminoethyl methacrylate, diethylaminoethyl methacrylate, bisglycidyl methacrylate, polyethylene glycol dimethacrylate, methacryloxy ethyl phosphate, and the like. These monomers may used alone, or two or more kinds thereof may be used concurrently. The above "(meth)acryl" refers to both or any one of acryl and methacryl.

Examples of another vinyl-based monomer include olefin-based monomers such as ethylene, propylene, butylene, butadiene, and isoprene; vinyl ester-based monomers such as vinyl formate, vinyl acetate, vinyl propionate, and vinyl benzoate; acrylic acids and an α- or β-alkyl derivative thereof such as acrylic acid, methacrylic acid, α-ethyl acrylate, and crotonic acid; an unsaturated dicarboxylic acid and a monoester or diester derivative thereof such as fumaric acid, maleic acid, citraconic acid, and itaconic acid; succinic acid mono(meth)acryloyloxy ethyl ester, (meth)acrylonitrile, acrylamide, and the like.

The weight average molecular weight (Mw) of the thermoplastic resin ranges, for example, from 150000 to 500000. In addition, the molecular weight distribution (Mw/Mn) of the thermoplastic resin ranges, for example, from 2 to 20. The thermoplastic resin may have plural peaks or shoulders in a molecular weight distribution measured by gel permeation chromatography (GPC).

The weight average molecular weight (Mw) is measured by gel permeation chromatography (GPC). In the molecular weight measurement performed by GPC, a GPC•HLC-8120 manufactured by TOSOH CORPORATION is used as a measurement device, a TSKgel SuperHM-M column (15 cm) manufactured by TOSOH CORPORATION is used, and THF is used as a solvent. The weight average molecular weight is calculated from the measured results by using a molecular weight calibration curve created by a standard sample of monodisperse polystyrene. Hereinbelow, the weight average molecular weight is measured in the same manner. The number average molecular weight (Mn) is also measured in the same manner as in the weight average molecular weight (Mw), and from the values, the molecular weight distribution (Mw/Mn) is calculated.

The styrene-based thermoplastic elastomer resin is a thermoplastic elastomer resin having at least a repeating unit derived from a styrene-based monomer. Examples of the thermoplastic elastomer resin include those having a property of rubber at normal temperature (for example, 25° C.) and having a property of being softened at a high temperature similarly to thermo-plastics.

Specific examples of the styrene-based thermoplastic elastomer resin include block copolymers of the styrene-based monomer and the olefin-based monomer. More specifically, the examples include polystyrene-polybutadiene-polystyrene, polystyrene-polybutadiene/butylene-polystyrene, polystyrene-polyethylene/butylene-polystyrene, polystyrene-polyisoprene-polystyrene, polystyrene-hydrogenated polybutadiene-polystyrene, polystyrene-hydrogenated polyisoprene-polystyrene, polystyrene-hydrogenated poly(isoprene/butadiene)-polystyrene, and the like.

In the above specific examples, for example, the "polystyrene-polybutadiene/butylene-polystyrene" refers to a structure in which a block of butadiene has been partially hydrogenated in a block copolymer formed when a block of polystyrene, a block of polybutadiene, and a block of polystyrene bind to each other in this order. That is, the "polybutadiene/butylene" refers to a block in which a butadiene moiety is mixed with a butylene moiety where butadiene has been hydrogenated. In the above specific examples, for example, the "hydrogenated polybutadiene" means that hydrogen has been added to a double bond of polybutadiene.

Regarding those block copolymers, block copolymers in which a polar group is put in a soft segment interposed between polystyrenes may be used. Examples of the polar group include a hydroxyl group, a carboxyl group, an amino group, an acyl group, and the like.

The weight average molecular weight of the styrene-based thermoplastic elastomer resin ranges, for example, from 30000 to 300000. Examples of commercially available products of the styrene-based thermoplastic elastomer resin include Tuftec M1911, Tuftec M1943, Tuftec MP10, Asaprene T439, and Tufprene A manufactured by Asahi Kasei Corporation; DYNARON 8630P manufactured by JSR Corporation; and the like.

When the binder resin is a mixture of the thermoplastic resin and the thermoplastic elastomer resin, the content of the thermoplastic resin is, for example, from 50% by weight to 90% by weight, and may be from 50% by weight to 70% by weight, based on the total toner particles. In addition, the content of the thermoplastic elastomer resin is, for example, from 5% by weight to 50% by weight, and may be from 10% by weight to 40% by weight, based on the total toner particles.

Other Components

The toner particles may optionally contain other components such as a colorant, a release agent, a polymerization initiator, a charge-controlling agent, silica powder, and metal oxide, in addition to the vinyl-based resin and the styrene-based thermoplastic elastomer resin. The polymerization initiator will be described later in detail. These other components may be internally added by, for example, being kneaded into the binder resin, or may be externally added by, for example, being subjected to a mixing process after the toner particles are obtained. The toner particles do not necessarily contain a colorant when they are made into a transparent toner.

Known pigments or dyes are used as the colorant, and specific examples thereof include the following respective pigments of yellow, magenta, cyan, and black.

Examples of the yellow pigment include compounds represented by a condensed azo compound, an isoindolinone compound, an anthraquinone compound, an azo metal complex compound, a methine compound, and an allylamide compound.

Examples of the magenta pigment include a condensed azo compound, a diketopyrrolopyrrole compound, anthraquinone, a quinacridone compound, a base dye lake compound, a naphthol compound, a benzimidazolone compound, a thioindigo compound, and a perylene compound.

Examples of the cyan pigment include a copper phthalocyanine compound and a derivative thereof, an anthraquinone compound, a base dye lake compound, and the like.

Examples of the black pigment include carbon black, aniline black, acetylene black, iron black, and the like.

The release agent is not particularly limited, and examples thereof include plant wax such as carnauba wax, sugar wax, and tree wax; animal wax such as bees wax, insect wax, whale wax, and wool wax; synthetic hydrocarbon wax such as Fischer-Tropsch wax (FT wax) having an ester in a side chain, polyethylene wax, polypropylene wax, and polyester wax; and the like. The release agent may be used alone, or two or more kinds thereof may be used.

The charge-controlling agent is not particularly limited, and charge-controlling agents known in the related art are used. Examples thereof include positively chargeable charge-controlling agents such as a nigrosine dye, a fatty acid-modified nigrosine dye, a carboxyl group-containing fatty acid-modified nigrosine dye, a quaternary ammonium salt, an amine-based compound, an amide-based compound, an imide-based compound, and an organic metal compound; negatively chargeable charge-controlling agents such as a metal complex of oxycarboxylic acid, a metal complex of an azo compound, a metal complex salt dye, and a salicylic acid derivative; and the like. These charge-controlling agents may be used alone, or two or more kinds thereof may be used.

The metal oxide is not particularly limited, and examples thereof include titanium oxide, aluminum oxide, magnesium oxide, zinc oxide, strontium titanate, barium titanate, magnesium titanate, calcium titanate, and the like. These metal oxides may be used alone, or two or more kinds thereof may be used.

Method of Preparing Toner Particles

The method of preparing toner particles used in the present exemplary embodiment is not particularly limited, and the toner particles are prepared by, for example, methods of preparing pulverized toner particles, dried toner particles emulsified in a liquid, or polymerized toner particles.

Specifically, for example, a binder resin and optionally other additives such as a colorant and a release agent are put in a mixing device such as a Henschel mixer so as to be mixed, and the mixture is melted and kneaded by a double screw extruder or the like. Subsequently, the mixture is cooled by a drum flaker or the like and roughly pulverized by a pulverizer such as a hammer mill, and the resultant is finely pulverized by a pulverizer such as a jet mill, followed by classification by using an air classifier machine or the like, thereby obtaining pulverized toner particles.

Alternatively, for example, a binder resin and optionally other additives such as a colorant, a release agent, and a polymerization initiator are dissolved in a solvent such as ethyl acetate and emulsified and suspended in water supplemented with a dispersion stabilizer such as calcium carbonate, and the solvent is removed. Thereafter, the dispersion stabilizer is removed, and the obtained particles are filtered and dried, thereby obtaining dried toner particles emulsified in a liquid.

Alternatively, for example, a composition that contains a polymerizable monomer forming a binder resin and optionally contains a colorant, a polymerization initiator (for example, benzoyl peroxide, lauroyl peroxide, isopropyl peroxycarbonate, cumene hydroperoxide, 2,4-dichlorylbenzoyl peroxide, methyl ethyl ketone peroxide, or the like), and other additives is added to a water phase under stirring to prepare particles, followed by a polymerization reaction, and the particles are filtered and dried, thereby obtaining polymerized toner particles.

The mixing ratio of the respective materials (a thermoplastic elastomer and a thermoplastic resin, and optionally a colorant, other additives, and the like) used for obtaining a toner is set in consideration of required characteristics, colors, and the like.

The toner particles obtained in the above manner are finely pulverized in carrier oil by using, for example, a known pulverizing device such as a ball mill, a beads mill, or a high-pressure wet type fine particle-preparing device, whereby toner particles for a liquid developer of the present exemplary embodiment are obtained.

Characteristics of Toner Particles

The volume average particle size D50v of the toner particles ranges, for example, from 0.5 μm to 5.0 μm, or may be from 0.8 μm to 4.0 μm or from 1.0 μm to 3.0 μm.

The volume average particle size D50v of the toner particles is measured by a measurement device Coulter Multisizer (manufactured by Beckman Coulter, Inc.) in terms of toner particles of 2 μm or larger. Regarding toner particles of smaller than 2 μm, D50v is measured using a dynamic light scattering type volume average particle size distribution analyzer (for example, LB-500 (manufactured by HORIBA, Ltd.), Microtrac UPA (manufactured by NIKKISO CO., LTD.), or the like), or a laser diffraction/scattering type particle size distribution analyzer (for example, LS13 320 (manufactured by Beckman Coulter, Inc.), "LA-920" (manufactured by HORIBA, Ltd.), or the like). Regarding the particle size ranges (channels) divided based on the particle size distribution obtained by the above measurement, the cumulative distribution is created in terms of volume from the small size particles, and a particle size reaching cumulative 50% is defined as a volume D50v.

The content of the toner particles ranges, for example, from 0.5% by weight to 40% by weight, or may be from 1% by weight to 30% by weight, based on the entire liquid developer.

Carrier Liquid

The insulating liquid in the present exemplary embodiment is a carrier liquid as a liquid in which toner particles are dispersed. The carrier liquid is not particularly limited, and examples thereof include non-aqueous solvents having a volume resistivity of $1.0\times10^{10}\Omega\cdot$cm or more. Among these, non-aqueous solvents that poorly dissolve the binder resin (that is, toner particles are present in the liquid developer as a solid) are particularly exemplified.

The non-aqueous solvent includes solvents other than water. This solvent may be a mixture of water and a solvent other than water or may be a solvent that does not contain water as far as possible.

Examples of the non-aqueous solvent include aliphatic hydrocarbon solvents such as paraffin oil (as commercially available products, Moresco White MT-30P, Moresco White P40, and Moresco White P70 manufactured by MATSUMURA OIL Co., Ltd., Isopar L and Isopar M manufactured by Exxon Mobil Corporation, and the like), and hydrocarbon-based solvents such as naphthene-based oil (as commercially available products, Exxsol D80, Exxsol D110, and Exxsol D130 manufactured by Exxon Mobil Corporation, Naphtesol L, Naphtesol M, Naphtesol H, New Naphtesol 160, New Naphtesol 200, New Naphtesol 220, and New Naphtesol MS-20P manufactured by Nippon Oil Corporation, and the like). These solvents may contain an aromatic compound such as toluene.

Among the above components, one kind may be used alone, or two or more kinds may be used as a mixture, as the non-aqueous solvent. When two or more kinds of non-aqueous solvents are used as a mixture, a mixing system of a paraffin-based solvent and plant oil and a mixing system of a silicone-based solvent and plant oil are exemplified.

Characteristics of Carrier Liquid

The volume resistivity of the carrier liquid ranges, for example, from $1.0\times10^{10}\Omega\cdot$cm to $1.0\times10^{14}\Omega\cdot$cm, and may range from $1.0\times10^{10}\Omega\cdot$cm to $1.0\times10^{13}\Omega\cdot$cm.

The liquid developer may optionally further contain other components. Examples of other components include a polymerization initiator, a curable material, a dispersant, an emulsifier, a surfactant, an antioxidant, a moisturizer, a thickening agent, a foaming agent, an antifoaming agent, a coagulating agent, a gelating agent, an anti-sedimentation agent, an antistatic agent, an antiaging agent, a softener, a plasticizer, a filler, a fragrance-imparting agent, an anti-adhesion agent, a release agent, and the like.

EXAMPLES

Hereinbelow, the present invention will be described based on examples, but the present invention is not limited thereto. In the examples, "part(s)" represents "part(s) by weight", and "%" represents "% by weight", unless otherwise specified.

Method of Measuring Various Characteristics

First, methods of measuring physical properties of a toner and the like used in examples and comparative examples will be described.

Method of Measuring Toner Particle Size and Particle Size Distribution

In the present invention, for measuring the toner particle size and the particle size distribution, a Multisizer II model (manufactured by Beckman Coulter, Inc.) is used as a measurement device, and ISOTON-II (manufactured by Beckman Coulter, Inc.) is used as an electrolytic solution.

In the measurement method, 0.5 mg to 50 mg of a measurement sample is added to a surfactant as a dispersant which is preferably 2 ml of a 5% aqueous solution of sodium alkylbenzene sulfonate. This solution is added to 100 ml to 150 ml of the electrolytic solution. The electrolytic solution in which the sample is suspended is dispersed for about 1 minute by using an ultrasonic dispersing machine, and the particle size distribution of particles of 2 μm to 60 μm is measured with the Multisizer II model by using an aperture having an aperture diameter of 100 μm, whereby the volume average particle size is calculated. The number of particles measured is 50000.

The particle size distribution of the toner is obtained in the following manner. Regarding the particle size ranges (channels) obtained by dividing the measured particle size distribution, the cumulative volume distribution is created starting from the small size particles. The cumulative volume average particle size reaching cumulative 16% is defined as D16v, the cumulative volume average particle size reaching cumulative 50% is defined as D50v, and the cumulative volume average particle size reaching cumulative 84% is defined as D84v.

The volume average particle size in the present invention is D50v, and a volume average particle size index GSDv is calculated from the following formula.

$$GSDv=\{(D84v)/(D16v)\}^{0.5} \quad \text{Formula:}$$

When the diameter of particles to be measured is less than 2 μm, the particle size distribution is measured using a laser diffraction/scattering type particle size distribution analyzer "LA-920" (manufactured by HORIBA, Ltd.) In the measurement method, an amount of a sample that is in a state of dispersion is adjusted so as to be about 2 g in terms of a solid content, and deionized water is added thereto so as to obtain about 40 ml of a solution. This solution is added to a cell until an appropriate concentration is obtained, followed by waiting for about 2 minutes, and the sample is measured when the concentration in the cell is almost stabilized. The obtained volume average particle size for each channel is accumulated from the particles having a small volume average particle size, and the volume average particle size reaching cumulative 50% is defined as a volume average particle size.

Method of Measuring Weight Average Molecular Weight and Molecular Weight Distribution of Resin In the present invention, the molecular weight of the binder resin and the like is measured under the following conditions. For GPC, an "HLC-8120GPC, SC-8020 device (manufactured by TOSOH CORPORATION) is used. As a column, "TSKgel, Super HM-H (manufactured by TOSOH CORPORATION, 6.0 mm ID×15 cm)" is used in a number of 2, and as an eluent, THF (tetrahydrofuran) is used. The experiment is performed using an IR detector under experimental conditions of a sample concentration of 0.5%, a flow rate of 0.6 ml/min, a sample injection amount of 10 μl, and a measurement temperature of 40° C. A calibration curve is created from 10 samples including "A-500", "F-1", "F-10", "F-80", "F-380", "A-2500", "F-4", "F-40", "F-128", and "F-700" of "polystyrene standard sample TSK standards" manufactured by TOSOH CORPORATION.

Example 1

Preparation Apparatus

A dyno-mill KDL-A model (0.6 L zirconia vessel, manufactured by SHINMARU ENTERPRISES CORPORATION) as the pulverizing device 60 shown in FIG. 1, a 6 L stainless steel pressure-resistant container (manufactured by UNI-CONTROLS. CO., LTD.) as the tank 52 shown in FIG. 1, a multipurpose three-one motor (manufactured by AS ONE Corporation) as the stirring device 50, and a pressure sending pump for a dispersion (manufactured by Viking Pump, Inc.) as the liquid-sending device 54 shown in FIG. 1 are connected to each other through a 10A sanitary pipe (manufactured by OSAKA SANITARY) so as to form the liquid-sending route 76. Monitoring is performed by a Coriolis flowmeter (FD-SS20A, manufactured by KEYENCE CORPORATION, not shown in FIG. 1) that measures the flow rate and pressure of the pressure sending pump on the liquid-sending route 76 and by an electric pressure gauge (AP-V80, manufactured by KEYENCE CORPORATION) as the pressure gauge 80 shown in FIG. 1. The dyno-mill, the pressure sending pump, and the liquid-sending route 76 are controlled by a sequencer (KV1000, manufactured by KEYENCE CORPORATION) as a control device (not shown in the drawing) of the preparation apparatus 100 shown in FIG. 1.

Preparation of Liquid Developer 15 parts by weight of a cyan pigment (pigment blue manufactured by Clariant, Inc.) is added to 60 parts by weight of a styrene acrylic resin (manufactured by FUJIKURA KASEI CO., LTD., weight average molecular weight: 150000), 25 parts by weight of a styrene-based thermoplastic resin (manufactured by Asahi Kasei Corporation, Asaflex 805), and 10 parts by weight of a styrene-based thermoplastic elastomer (manufactured by Asahi Kasei Corporation, "Tufprene A", a styrene-butadiene block copolymer), followed by kneading with a Banbury mixer, and raw material powder of 12 μm is obtained using a jet mill pulverizer.

80 parts of paraffin oil as a carrier liquid is added based on 20 parts by weight of this dried toner, and a phenyl maleimide-based charge-controlling agent (B1616AE, manufactured by FUJIFILM Fine Chemicals, a compound of the following chemical formula) is further added thereto in an amount of 0.1% by weight. The dispersion having a total weight of 4.7 kg is stirred with a homogenizer (Robomix manufactured by PRIMIX Corporation) and then put in a 6 L stainless steel pressure-resistant container to start wet pulverizing.

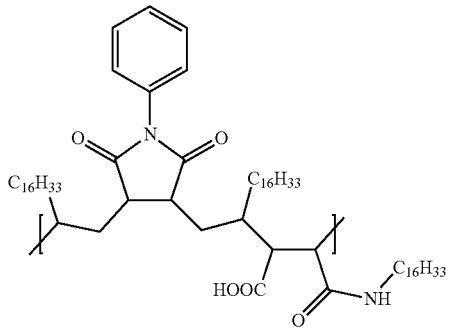

The weight average molecular weight of the phenyl maleimide-based charge-controlling agent is 16700, and in the formula, n is 15 to 20.

Preparation Conditions of Liquid Developer

The rotation frequency of the pressure sending pump as the liquid-sending device 54 shown in FIG. 1 is continuously variable using a ring-cone type transmission, and the pump is driven at a constant rate of 120 ml/min. In addition, the rotation frequency of the dyno-mill as the pulverizing device 60 of FIG. 1 is set to 3300 rpm, glass beads having a bead diameter of 0.6 mm are used as media of the dyno-mill, and a filling rate of the beads in the dyno-mill is set to 80%.

Setting Relational Expression

Figure 4:
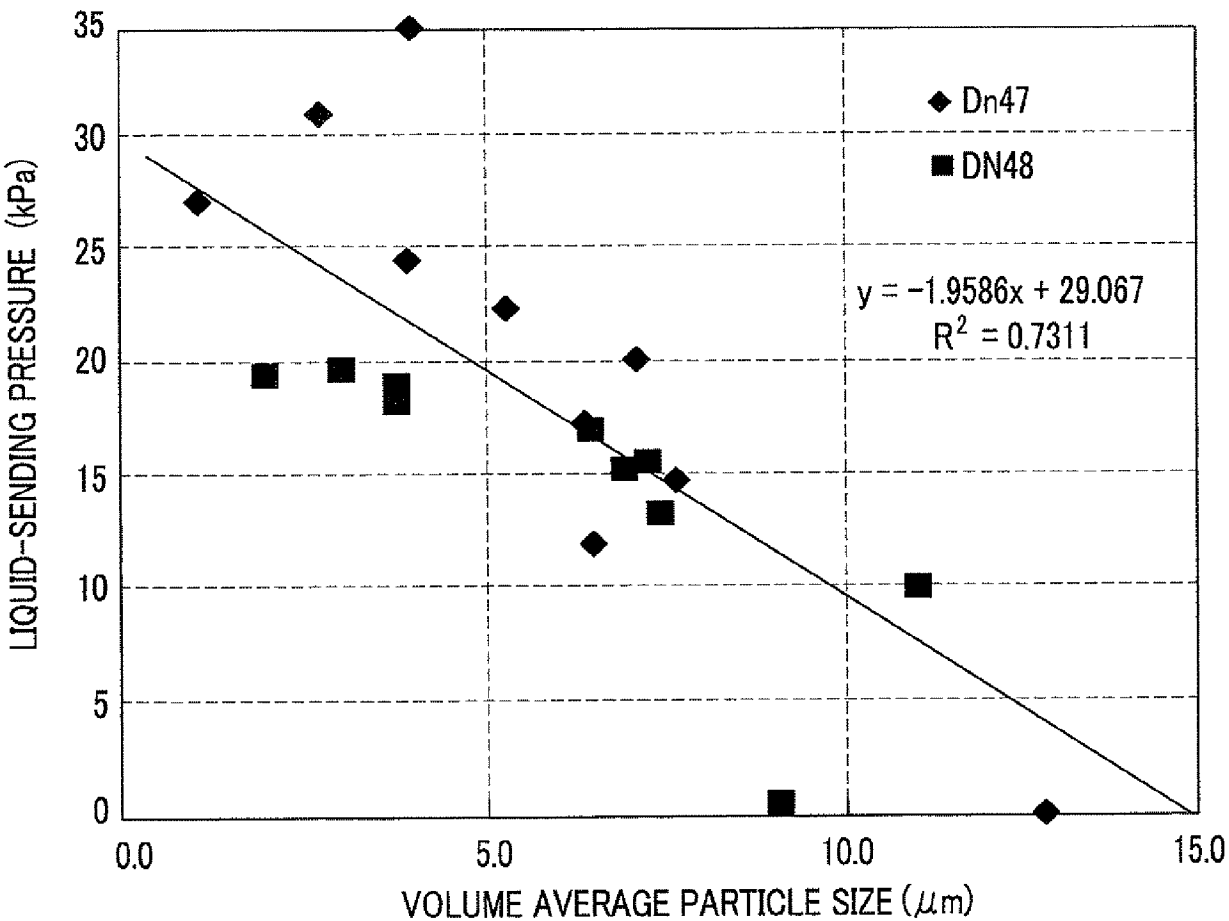
FIG. 4 is a graph showing the relationship between an actually measured volume average particle size of toner particles in a dispersion and a liquid-sending pressure of the dispersion in a step of pulverizing of Example 1.

A toner of which an initial volume average particle size of toner particles in the dispersion is 12.5 μm is subjected to wet pulverizing under the preparation conditions described above, and the liquid-sending pressure of the pressure gauge 80 is recorded every 10 minutes. Thereafter, the dispersion is sampled so as to be used for measuring the volume average particle size. The obtained sample is diluted and dispersed with ultrasonic waves, and then the volume average particle size is measured using a laser diffraction/scattering type particle size distribution analyzer (LA-920 manufactured by HORIBA, Ltd.). Subsequently, the correlation between the liquid-sending pressure and the volume average particle size of the toner particles is determined in linear correlation by using a least-squares method, and the results are shown in FIG. 4. FIG. 4 is a graph created based on data that are obtained when the above liquid developer having the same composition is prepared in two batches (◆: Dn47, ■: Dn48).

For example, from the results of the graph in FIG. 4, provided that the target volume average particle size D of the toner particles is "2.5 μm", the initial volume average particle size $D_0$ of the toner particles is "12.5", the constant A is "2.33", and the constant B is "−1.95" in the relational expression $P=AD_0-BD$, and at this time, the liquid-sending pressure P at the time of the target volume average particle size is expected to be "24.1 kPa".

Experiment for Checking Reproducibility

A liquid developer is separately prepared in the same manner as in the above section "Preparation of Liquid Developer", and a liquid-sending pressure for stopping pulverizing is expected to be 24.2 kPa based on the above relational expression such that the volume average particle size of the toner particles in the dispersion becomes 2.5 μm. This experiment is carried out three times under the same conditions as the preparation conditions described above. As a result, the volume average particle sizes of the liquid developer obtained by stopping pulverizing at a point in time when the liquid-sending pressure P becomes 24.2 kPa are 2.6 μm, 2.8 μm, and 2.2 μm respectively. From these results, it is proved that even if the volume average particle size of the toner particles in the liquid developer is not measured in-situ, based on the relational expression obtained by a preliminary experiment, the volume average particle size is controlled to be 2.5±0.3 μm.

Example 2

Preparation Apparatus

The same preparation apparatus as that in Example 1 is used.

Preparation of Liquid Developer

A liquid developer is prepared based on Example 1, except that the carrier liquid of Example 1 is changed to "Moresco White MT-30P" manufactured by MATSUMURA OIL Co., Ltd., and that 2% by weight of "DYNARON 2324P" manufactured by JSR Corporation is added as a dispersant instead of the phenyl maleimide-based charge-controlling agent.

Preparation Conditions of Liquid Developer

The liquid developer is prepared based on Example 1, except that the beads used for the dyno-mill as the pulverizing device 60 shown in FIG. 1 are changed to alumina having a diameter of 0.4 mm.

Setting Relational Expression

A relational expression is determined by performing sampling in the same manner as in Example 1, except that the preliminary experiment is performed under a condition of N=1. The results are shown in FIG. 5.

Figure 5:
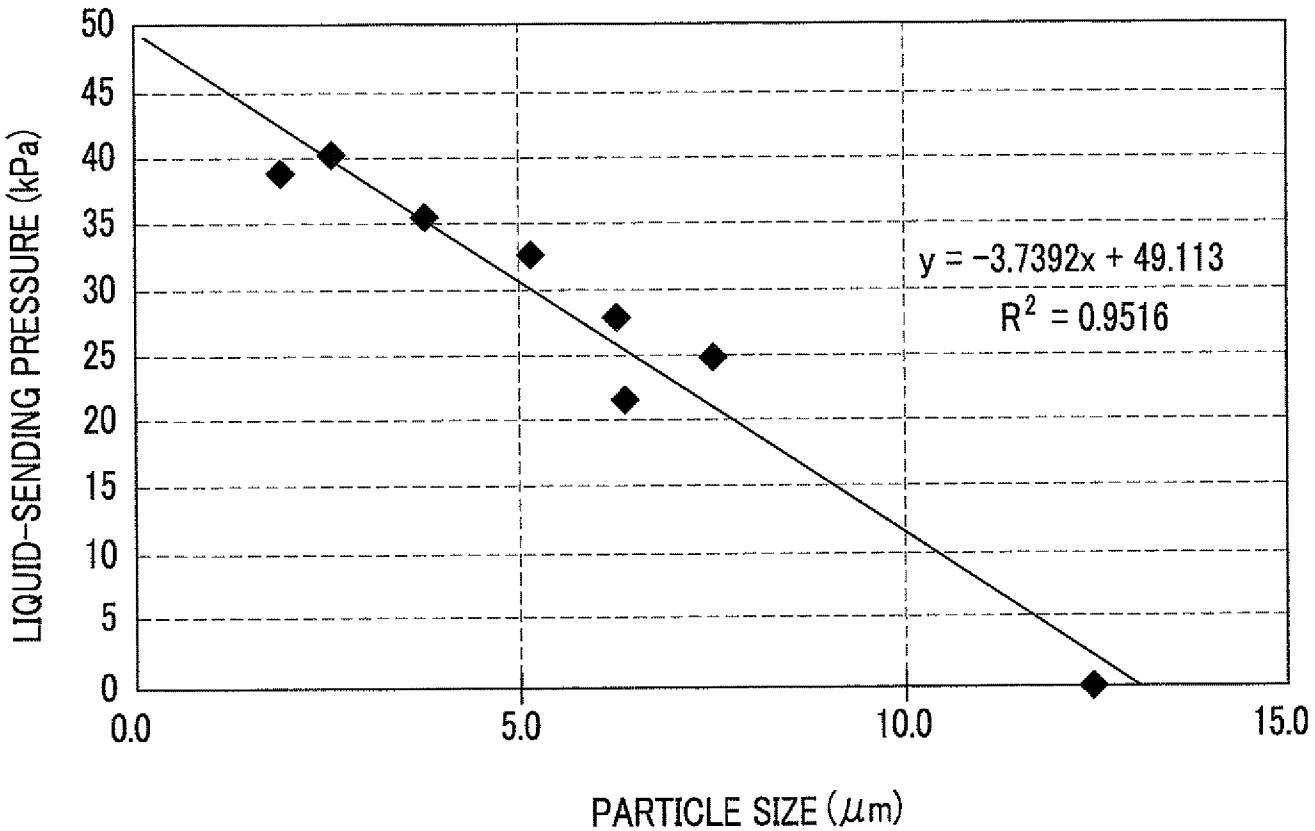
FIG. 5 is a graph showing the relationship between an actually measured volume average particle size of toner particles in a dispersion and a liquid-sending pressure of the dispersion in a step of pulverizing of Example 2.

For example, from the results of the graph of FIG. 5, provided that the target volume average particle size D of toner particles is "3.2 μm", the initial volume average particle size $D_0$ of the toner particles is "12.5", the constant A is "3.93", and the constant B is "−3.74" in the relational expression $P=AD_0-BD$, at this time, the liquid-sending pressure P at the time of the target volume average particle size is expected to be "37.1 kPa".

Experiment for Checking Reproducibility

A liquid developer is separately prepared in the same manner as in the above section "Preparation of Liquid Developer" of Example 2, and a liquid-sending pressure for stopping pulverizing is expected to be 37.1 kPa based on the above relational expression such that the volume average particle size of the toner particles in the dispersion becomes 3.2 μm. This experiment is carried out three times under the same conditions as the preparation conditions described above. As a result, the volume average particle sizes of the liquid developer obtained by stopping pulverizing at a point in time when the liquid-sending pressure P becomes 37.1 kPa are 2.9 μm, 3.1 μm, and 3.6 μm respectively. From these results, it is proved that even if the volume average particle size of the toner particles in the liquid developer is not measured in-situ, based on the relational expression obtained by a preliminary experiment, the volume average particle size is controlled to be 3.2±0.4 μm.

Example 3

Preparation Apparatus

The same preparation apparatus as that in Example 1 is used.

Preparation of Liquid Developer

A cyan toner (volume average particle size: 6.5 μm, a toner including a polyester resin as a binder resin) of "a developer for a DC1250 series" manufactured by Fuji Xerox Co., Ltd. is classified by a dry cyclone, and the fine powder portion (volume average particle size: 2.9 μm to 3.6 μm) is used as toner particles. 75 parts of silicone oil "KF-96-20cs" manufactured by Shin-Etsu Silicones is added thereto based on 25 parts of the toner particles and dispersed by stirring.

Preparation Conditions of Liquid Developer

The liquid developer is prepared based on Example 1, except that the beads used for the dyno-mill as the pulverizing device 60 of FIG. 1 are changed to zirconia having a diameter of 2.5 mm, and that a filling rate of the beads in the dyno-mill is set to 85%.

Setting Relational Expression

Figure 6:
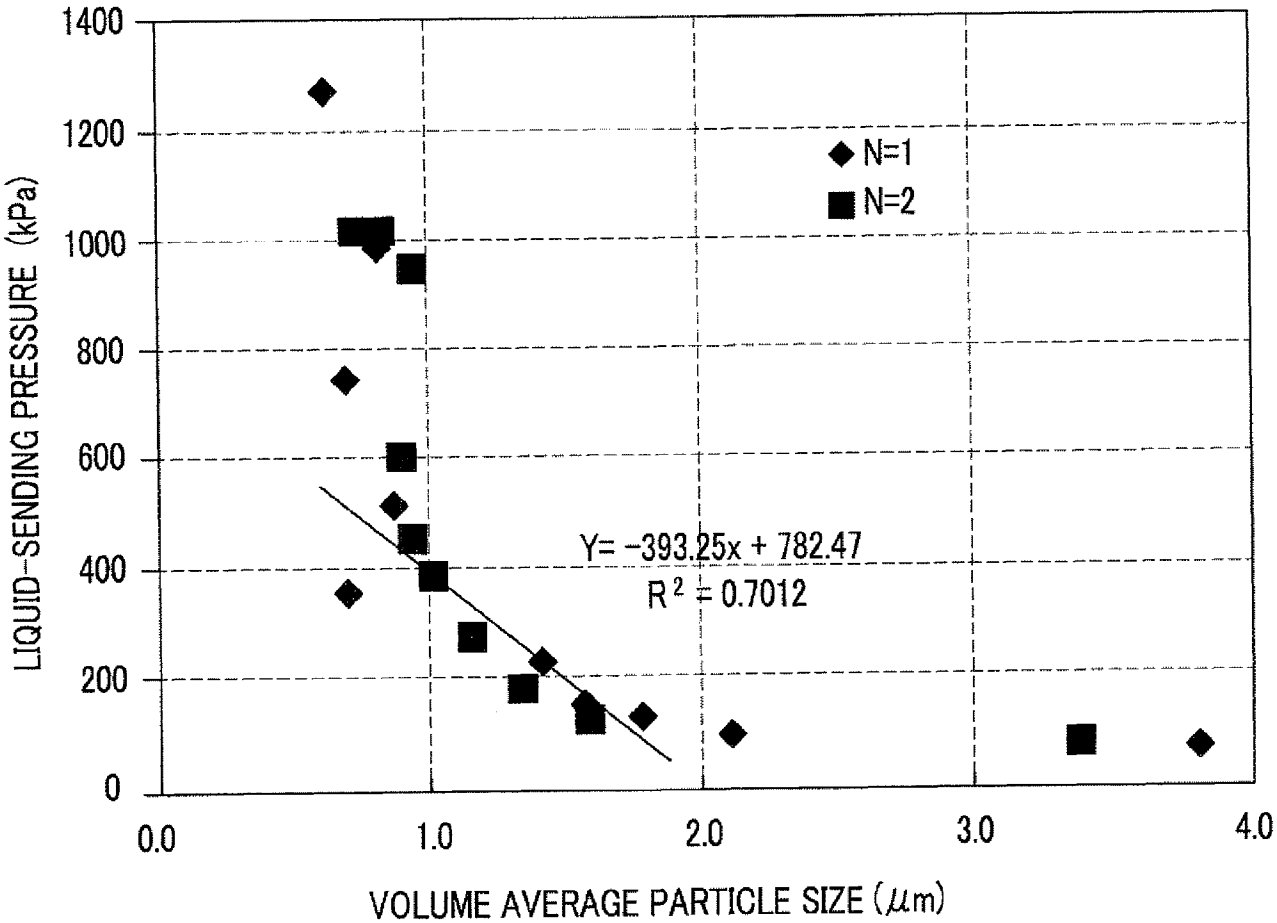
FIG. 6 is a graph showing the relationship between an actually measured volume average particle size of toner particles in a dispersion and a liquid-sending pressure of the dispersion in a step of pulverizing of Example 3.

A relational expression is determined by performing sampling in the same manner as in Example 1, except that the preliminary experiment is performed under a condition of N=2. The results are shown in FIG. 6. In addition, since linearity is not formed in the early stage of pulverizing (portion where a particle size is large) and in the late stage of pulverizing (portion where a particle size is saturated), these portions are excluded. That is, the samples employed for the least-squares method includes 12 points in the center.

For example, from the results of the graph of FIG. 6, provided that the target volume average particle size D of toner particles is "1.0 μm", the initial volume average particle size $D_0$ of the toner particles is "6.5", the constant A is "120.38", and the constant B is "−393.25" in the relational expression $P=AD_0-BD$, at this time, the liquid-sending pressure P at the time of the target volume average particle size is expected to be "390 kPa".

Experiment for Checking Reproducibility

Figure 7:
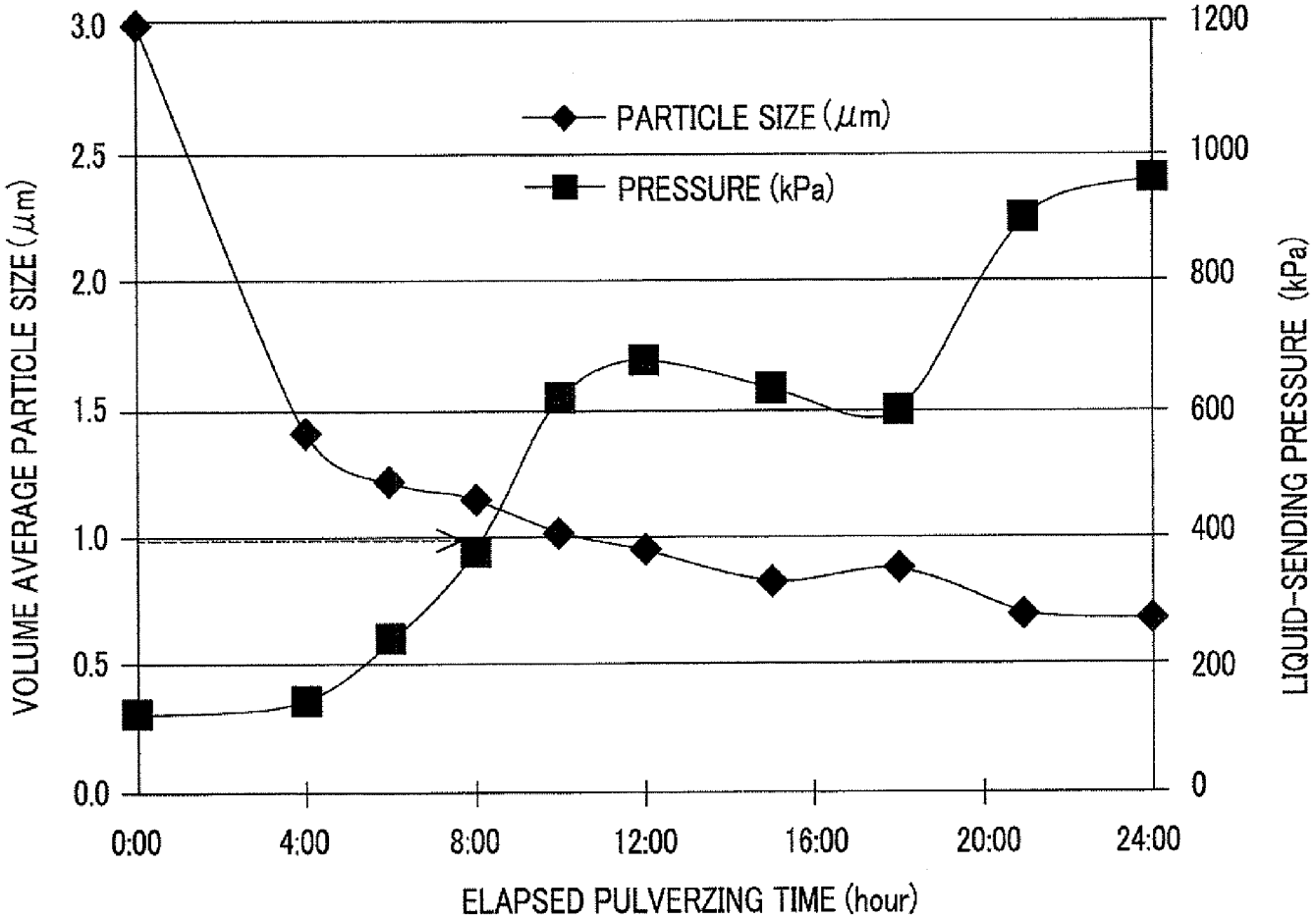
FIG. 7 is a graph showing the relationship between the actually measured volume average particle size of toner particles in the dispersion, the liquid-sending pressure of the dispersion, and elapsed pulverizing time in the step of pulverizing of Example 3.

The initial particle size D of the toner particles used in the reproduction experiment is 2.9 μm which is 0.3 μm smaller than the initial volume average particle size of the toner particles used in setting the relational expression. As described above, provided that the target volume average particle size D of the toner particles is "1.0 μm", the liquid-sending pressure P at the time of the target volume average particle size is expected to be "390 kPa". However, as shown in FIG. 7, when the dispersion is sampled at a point in time when the liquid-sending pressure becomes 390 kPa in the reproduction experiment, the volume average particle size of the toner particles is 1.1 μm which is within the margin of error. From the results of FIGS. 6 and 7, it is proved that even if the initial particle size $D_0$ of the toner particles is slightly outside the relational expression, the time to stop pulverizing is accurately estimated.

INDUSTRIAL APPLICABILITY

The liquid developer-preparing apparatus of the exemplary embodiment of the present invention is particularly useful for preparing a developer used for electrophotography, electrostatic recording, and the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid developer-preparing apparatus preparing a liquid developer obtained by dispersing toner particles in a liquid, the apparatus comprising:

a tank that stores a first dispersion including a liquid and toner particles;

a pulverizing device that pulverizes the toner particles in the first dispersion sent from the tank;

a liquid-sending route in which the first dispersion circulates between the tank and the pulverizing device;

a liquid-sending device that is provided to the liquid-sending route and sends the first dispersion;

a pressure gauge that is provided to the liquid-sending route and measures a liquid-sending pressure of the first dispersion; and a determination device that determines whether or not the toner particles in the first dispersion have been pulverized to a target volume average particle size, by comparing the liquid-sending pressure measured by the pressure gauge with a liquid-sending pressure obtained when the toner particles have the target volume average particle size, which is a pressure measured in advance using a second dispersion having the same composition as that of the first dispersion.

2. The liquid developer-preparing apparatus according to claim 1, further comprising a stirring device that is provided to the tank and stirs the first dispersion.

3. The liquid developer-preparing apparatus according to claim 1, wherein the determination device stores a relational expression: $P=AD_0-BD$ (in the expression, A and B represent constants that are determined by being measured in advance using the second dispersion having the same composition as that of the first dispersion, $D_0$ represents an initial volume average particle size of the toner particles, D represents a target volume average particle size of the toner particles, and P represents the liquid-sending pressure at the time of the target volume average particle size) between the liquid-sending pressure measured in advance using the second dispersion having the same composition as that of the first dispersion and the volume average particle size of the toner particles in the second dispersion, and determines that pulverizing of the toner particles has been completed, when the liquid-sending pressure measured by the pressure gauge becomes the stored liquid-sending pressure P at the time of the target volume average particle size.

4. The liquid developer-preparing apparatus according to claim 2, wherein the determination device stores a relational expression: $P=AD_0-BD$ (in the expression, A and B represent constants that are determined by being measured in advance using the second dispersion having the same composition as that of the first dispersion, $D_0$ represents an initial volume average particle size of the toner particles, D represents a target volume average particle size of the toner particles, and P represents the liquid-sending pressure at the time of the target volume average particle size) between the liquid-sending pressure measured in advance using the second dispersion having the same composition as that of the first dispersion and the volume average particle size of the toner particles in the second dispersion, and determines that pulverizing of the toner particles has been completed, when the liquid-sending pressure measured by the pressure gauge becomes the stored liquid-sending pressure P at the time of the target volume average particle size.

5. The liquid developer-preparing apparatus according to claim 1, wherein the pulverizing device is a wet medium stirring mill using beads, the beads are at least one kind of beads selected from a group consisting of zirconia, alumina, and glass, a diameter of the beads is from about 0.2 mm to about 3 mm, a beads filling rate in a cylinder of the wet medium stirring mill is about 75% or higher, and a circumferential speed of an agitator disc of the wet medium stirring mill is from about 5 m/s to about 20 m/s.

6. The liquid developer-preparing apparatus according to claim 2, wherein the pulverizing device is a wet medium stirring mill using beads, the beads are at least one kind of beads selected from a group consisting of zirconia, alumina, and glass, a diameter of the beads is from about 0.2 mm to about 3 mm, a beads filling rate in a cylinder of the wet medium stirring mill is about 75% or higher, and a circumferential speed of an agitator disc of the wet medium stirring mill is from about 5 m/s to about 20 m/s.

* * * * *